US006923588B1

(12) United States Patent
Hsieh

(10) Patent No.: US 6,923,588 B1
(45) Date of Patent: Aug. 2, 2005

(54) RETRACTILE MECHANISM FOR REFILL OF WRITING INSTRUMENT

(76) Inventor: Ming-Jen Hsieh, No. 21, Sec. 3, Mu-Hsin Rd., Wen-Shan District, Taipei (TW)

( * ) Notice: Subject to any disclaimer, the term of this patent is extended or adjusted under 35 U.S.C. 154(b) by 0 days.

(21) Appl. No.: 11/002,118

(22) Filed: Dec. 3, 2004

(51) Int. Cl.[7] ..... B43K 5/16
(52) U.S. Cl. ..... 401/115; 401/104; 401/105
(58) Field of Search ..... 401/104, 105, 401/106, 115

(56) References Cited

U.S. PATENT DOCUMENTS 2,813,511 A * 11/1957 Kersten ..... 401/100

* cited by examiner

*Primary Examiner*—David J. Walczak
(74) *Attorney, Agent, or Firm*—Dennison, Schultz, Dougherty & MacDonald

(57) ABSTRACT

A retractile mechanism for refills of writing instrument includes an outer tube, a refill, an inner tube, and a compression spring. When a pen nib is thrown forth, an inner tube with load pushes the refill moving forwards by inertia; while a projecting edge on the inner tube passes through a button hole of the outer tube, an elastic button inserts through the button hole, presses and locks with the projecting edge; the inner tube and the extended nib point are ready for writing; when the elastic button is pulled out, both the inner tube and the refill retracts by the pushing of the compression spring, back to the storage status.

4 Claims, 3 Drawing Sheets

RETRACTILE MECHANISM FOR REFILL OF WRITING INSTRUMENT

BACKGROUND OF THE INVENTION

The present invention relates to a retractile mechanism for refills of writing instrument, especially to a writing instrument having a refill extending out and being positioned for writing when the writing instrument is thrown forth. While an elastic button on a clip is pulled out from a button hole on an outer tube, the refill retracts back to storage status.

There are various kinds of mechanism for retracting or extending the refills of writing instruments. Generally, a button is pressed or released for controlling the refill. Or The pen operates by adjusting the length of the penholder to extend or retract the refill, as an embodiment shown in U.S. Pat. No. 6,276,855 B1-"RETRACTILE PEN". However, the above-mentioned retractile mechanisms are out of date and lack of novelty. Thus there is a need to provide users a new writing instrument that retracts and extends the refill by a new designed mechanism.

SUMMARY OF THE INVENTION

Therefore it is a primary object of the present invention to provide a retractile mechanism for refills of writing instruments. The device is composed by a refill inserted inside an inner tube. Both the refill and the inner tube slide synchronously inside a penholder. The inner tube having a ring with load and a projecting edge for stopping. While a button hole is disposed on the outer tube and an elastic button is arranged on the pen clip so that the elastic button inserts through the button hole and presses on the inner tube elastically. When the pen nib is thrown forth, the inner tube with load pushes the refill moving forwards by inertia. Then the projecting edge on the inner tube passes through the button hole of the outer tube, the elastic button inserts through the button hole, presses and locks with the projecting edge. Thus the inner tube and the extended nib point are ready for writing. When the elastic button is pulled out, both the inner tube and the refill retracts by the pushing of the compression spring, back to the storage status.

It is a further object of the present invention to provide a retractile mechanism for refills of writing instruments. The diameter of the guiding slot on the rear end of the outer tube is a bit larger than that of the rear end of the inner tube so that the rear end of the inner tube inserts into the guiding slot and slides forward and backward freely. Thus when the inner tube moves inside the outer tube, the movement of the inner tube and the refill therein is more stable. Therefore, the refill won't wobble while users write.

Still a further object of the present invention is to provide a retractile mechanism for refills of writing instruments. When users pull out the pen clip for putting the writing instrument into the pocket, the elastic button is also pulled out simultaneously, while both the inner tube and the refill also retracts. Therefore, the problem of staining clothes by the writing instrument can be avoided.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
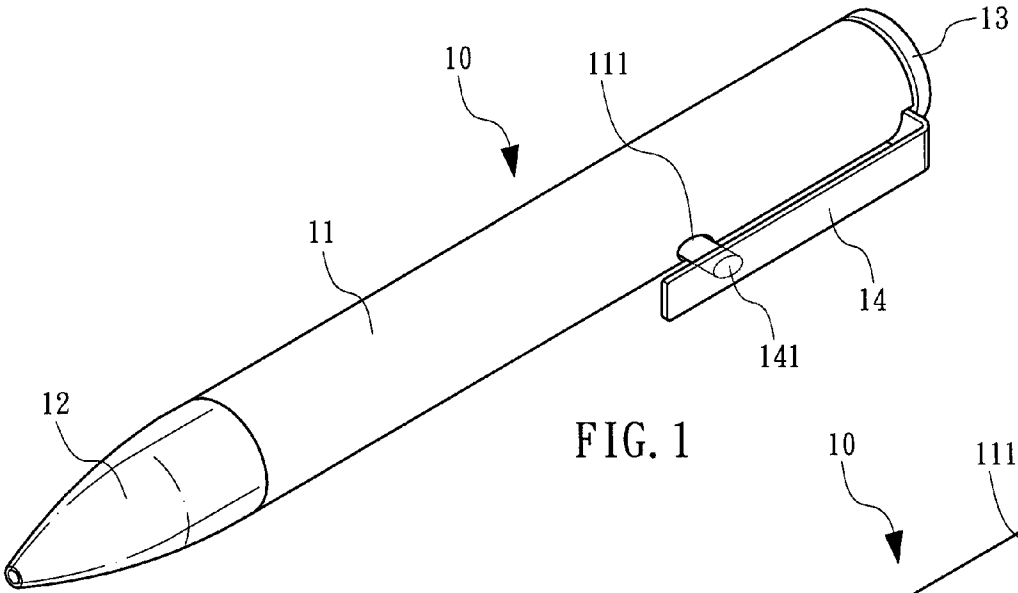
FIG. 1 is a perspective view of the present invention when the refill retracts.
Figure 2:
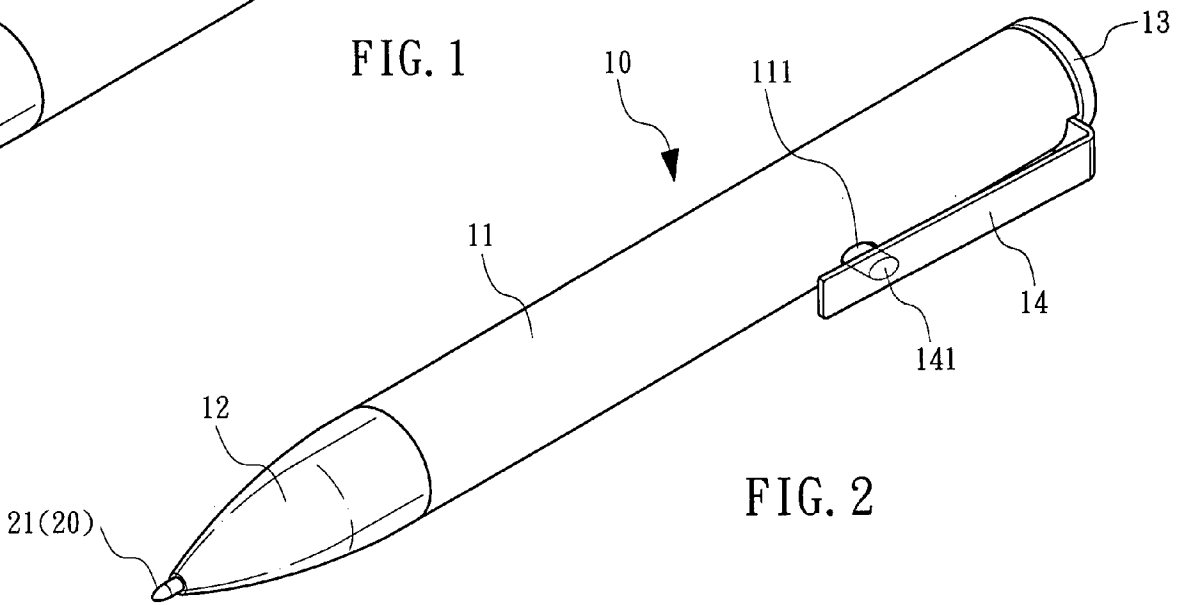
FIG. 2 is a perspective view of the present invention when the refill extends.
Figure 3:
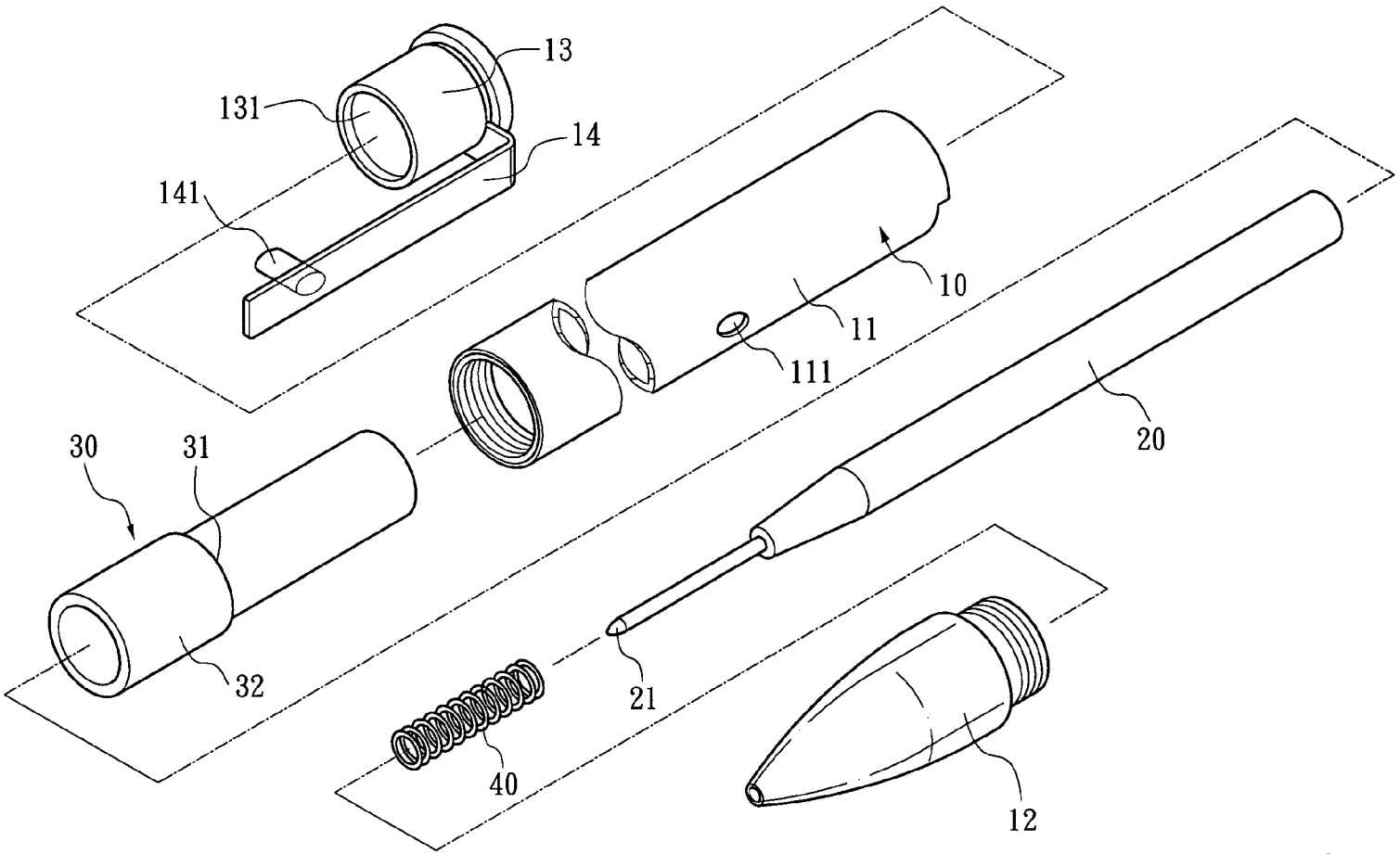
FIG. 3 is an explosive view of the present invention.

Refer from FIG. 1 to FIG. 3, the present invention includes an outer tube 10, a refill 20, an inner tube 30, and a compression spring 40. The outer tube 10 is composed by a penholder 11, a pen nib 12, a tail 13 and a pen clip 14. A cylindrical guiding slot 131 with certain depth is disposed inside the tail 13. The rear end of the refill 20 is inserted into the inner tube 30 so that both the refill 20 and the inner tube 30 slide synchronously inside the outer tube 10. The inner tube 30 is a tube with an opening in the front end and a closed rear end, and having a ring with load 32 and a projecting edge 31 for stopping. A button hole 111 is disposed on the penholder 11 of the outer tube 10 while an elastic button 141 is arranged on the pen clip 14 so that the elastic button 141 inserts through the button hole 111 and leans against the inner tube 30.

Figure 4:
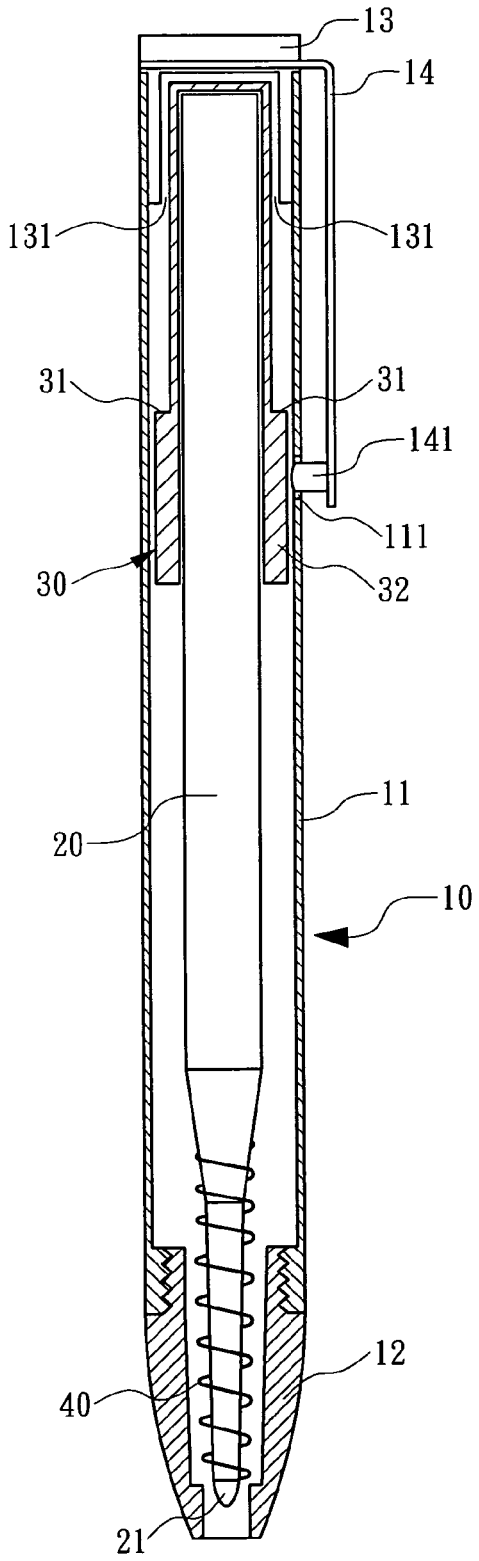
FIG. 4 is a cross-sectional view of the present invention when the refill retracts.

Refer to FIG. 4, by the clip force of the pen clip 14, the elastic button 141 through the button hole 111 presses on the inner tube 30 elastically. When users pull out the pen clip 14 for putting the writing instrument into the pocket, the elastic button 141 is also pulled out simultaneously, while both the inner tube 30 and the refill also retracts. Therefore, the problem of staining clothes by the writing instrument can be avoided.

Moreover, a guiding slot 131 with certain depth is installed on the rear side of the outer tube 10, inside the tail 13. The diameter of the guiding slot 131 is a bit larger than that of the rear end of the inner tube 30 so that the rear end of the inner tube 30 inserts into the guiding slot 131 and slides forward and backward freely. Thus when the inner tube 30 moves inside the outer tube 10, the movement of the inner tube 30 and the refill 20 therein is more stable. Therefore, the refill 20 won't wobble while users write.

Figure 5:
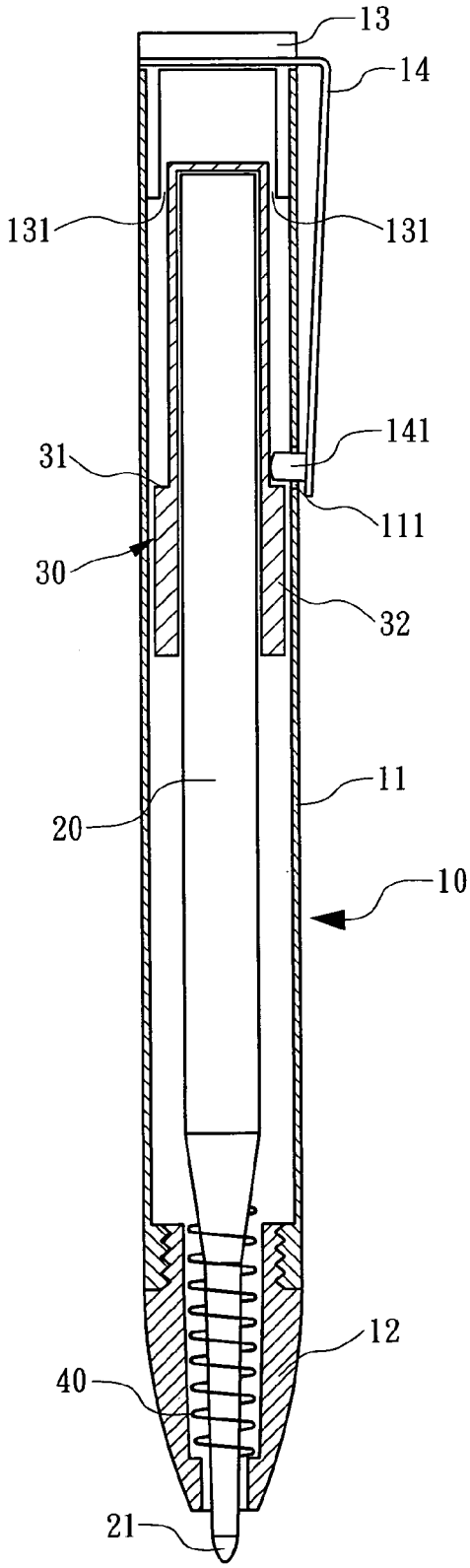
FIG. 5 is a cross-sectional view of the present invention when the refill extends.

Furthermore, refer to FIG. 5, the position of the button hole 111 corresponds to the position of the projecting edge 31. When the elastic button 141 inserts through the button hole 111, presses on the inner tube 30 and locks with the projecting edge 31, a nib point 21 of the refill 20 inserted inside the inner tube extend the pen nib 12, ready for writing.

A compression spring 40 is arranged on the front end of the refill 20 and installed inside the pen nib 12 so as to make the refill 20 being held elastically between the pen nib 12 and the inner tube 30.

The inner tube 30 having the ring with load 32 and the projecting edge 31 for stopping is made of copper or iron.

Refer to FIG. 2 & FIG. 5, when users want to extend the nib point 21, the outer tube 10 is held and the pen nib 12 is thrown forth. Then the inner tube 30 with load pushes the refill 20 moving forwards by inertia. When the projecting edge 31 on the inner tube 30 passes through the button hole 111 of the outer tube 10, the elastic button 141 inserts through the button hole 111, presses and locks with the projecting edge 31. Thus the inner tube 30 and the extended nib point 21 are ready for writing.

Refer to FIG. 1 & FIG. 4, when users want to retract the nib point 21, the clip 14 is pulled out so as to make the elastic button 141 out of the button hole 111 and the projecting edge 31. Then the refill 20 and the inner tube 30 retracts by the elasticity of the compression spring 40, the writing instrument is back to the storage status.

In addition, the inner tube 30 is made of copper or iron independently. The ring with load 32 is made independently and then put around a tube to form the inner tube 30. The edge of the ring with load 32 is used as the projecting edge 31 for stopper.

What is claimed is:

1. A retractile mechanism for refills of writing instrument comprising an outer tube, a refill, an inner tube, and a compression spring, wherein the outer tube having a penholder, a pen nib, a tail and a pen clip; a button hole is disposed on the penholder of the outer tube while an elastic button is arranged on the pen clip so that the elastic button inserts through the button hole and leans against the inner tube;

the refill is inserted into the inner tube and extends the pen nib;

the inner tube is disposed inside the outer tube, sliding forward and backward freely and having a ring with load and a projecting edge for stopping on the front end thereof;

the compression spring is arranged on the front end of the refill and installed inside the pen nib so as to make the refill being held elastically between the pen nib and the inner tube;

when the pen nib is thrown forth, the inner tube with load pushes the refill moving forwards by inertia; while the projecting edge on the inner tube passes the button hole of the outer tube, the elastic button inserts through the button hole, presses and locks with the projecting edge; the inner tube and the extended nib point are ready for writing;

when the elastic button is pulled out, both the inner tube and the refill retracts by the pushing of the compression spring, back to the storage status.

2. The retractile mechanism for refills of writing instrument as claimed in claim 1, wherein the elastic button is disposed on the rear end of the pen clip; by the clip force of the pen clip, the elastic button inserts through the button hole and presses on the inner tube elastically.

3. The retractile mechanism for refills of writing instrument as claimed in claim 1, wherein the ring with load and the projecting edge are integrated with the inner tube.

4. The retractile mechanism for refills of writing instrument as claimed in claim 1, wherein the ring with load is made independently and then is put around the inner tube integratedly.

* * * * *